United States Patent [19]

Dukkers

[11] Patent Number: 4,550,457

[45] Date of Patent: Nov. 5, 1985

[54] RESTING DEVICE WITH ROTATABLE COVERING ENVELOPE

[76] Inventor: Hendricus W. A. Dukkers, Oude Entrepot 16, 1018 Ad Amsterdam, Netherlands

[21] Appl. No.: 612,897

[22] Filed: May 22, 1984

[30] Foreign Application Priority Data

Jun. 10, 1983 [NL] Netherlands ..... 8302073

[51] Int. Cl.[4] ..... A47C 29/00; A47G 9/00

[52] U.S. Cl. ..... 5/414; 5/436

[58] Field of Search ..... 5/61, 60, 436, 414, 5/284, 100, 432, 433; 128/1 B

[56] References Cited

U.S. PATENT DOCUMENTS

| | | | |
|---|---|---|---|
| 2,149,167 | 2/1939 | Gail | 5/284 |
| 3,797,053 | 3/1974 | Mamo | 5/100 |
| 4,395,785 | 8/1983 | Huh | 5/432 |

FOREIGN PATENT DOCUMENTS

| | | | |
|---|---|---|---|
| 670541 | 1/1939 | Fed. Rep. of Germany | 5/284 |
| 404314 | 1/1934 | United Kingdom | 5/284 |

*Primary Examiner*—Alexander Grosz

*Attorney, Agent, or Firm*—Kane, Dalsimer, Kane, Sullivan and Kurucz

[57] ABSTRACT

The invention relates to a resting device.

According to the invention this resting device comprises an at least partly horizontal lying means extending at a distance above the ground and connected at its ends with uprights, which lying means is provided with an adjustably supported tube-shaped envelope, in which an opening is formed for getting in and out of the device, said envelope comprising on either side an end ring, which end rings are supported within the uprights by support rollers.

10 Claims, 4 Drawing Figures

RESTING DEVICE WITH ROTATABLE COVERING ENVELOPE

The invention relates to a resting device.

At several airfields travellers may get a resting room at their disposal, wherein it is possible to stay for several hours, e.g. if it is necessary to wait a rather long time between successive flights, or to stay during the whole night, e.g. when the aeroplane takes off very early. Larger industries and motorway restaurants are sometimes provided with such resting rooms as well.

However, these resting rooms have the disadvantage that they occupy much space and are therefore costly.

It is an object of the present invention to provide a resting device, wherein this disadvantage has been removed in an efficient manner.

For this purpose the resting device according to the invention is characterized in that the same comprises an at least partly horizontal lying means extending at a distance above the ground and connected at its ends with uprights, which lying means is provided with an adjustably supported tube-shaped envelope, in which an opening is formed for getting in and out of the device, said envelope comprising on either side an end ring, which end rings are supported within the uprights by support rollers.

This resting device, which is shaped as a rest cabin, will be designed in general for one person only, but may also be dimensioned for two persons if desired. In this rest cabin it is possible to isolate oneself from the disturbing noises and from the impressions of the surroundings. In this manner it is possible to provide the required privacy to a resting person, while using only very little space.

A favourable embodiment of the resting device according to the invention is characterized in that the tube-shaped envelope is substantially formed as a circle cylinder which is rotatable about its at least approximately horizontal longitudinal axis, said support rollers having axes of rotation, which are parallel to said longitudinal axis.

In this embodiment the opening in the rotatable cylinder is bounded on two sides by an edge which is parallel to the longitudinal axis of the rotatable cylinder and on the other two sides by the end rings or by the uprights.

A simple and compact embodiment of the resting device according to the invention is characterized in that the lying means is connected on either side to a stationary end cylinder, which is supported by a base member and which is provided with a vertical end wall, each end cylinder forming one of the said uprights, said end cylinders being directed with their open sides towards each other and being coaxial with the intermediate rotatable cylinder, while each support roller is supported by a carrier, which is mounted within one of the base members and which is connected to this base member, the end rings extending over the whole circumference on both sides of the rotatable cylinder, while each end ring is at least partly received in a stationary outer ring with a slight play, each outer ring forming a part of one of the end cylinders and having openings for the support rollers.

The invention will hereafter be elucidated with reference to the drawings, which show an embodiment of the resting device according to the invention by way of example.

Figure 2:
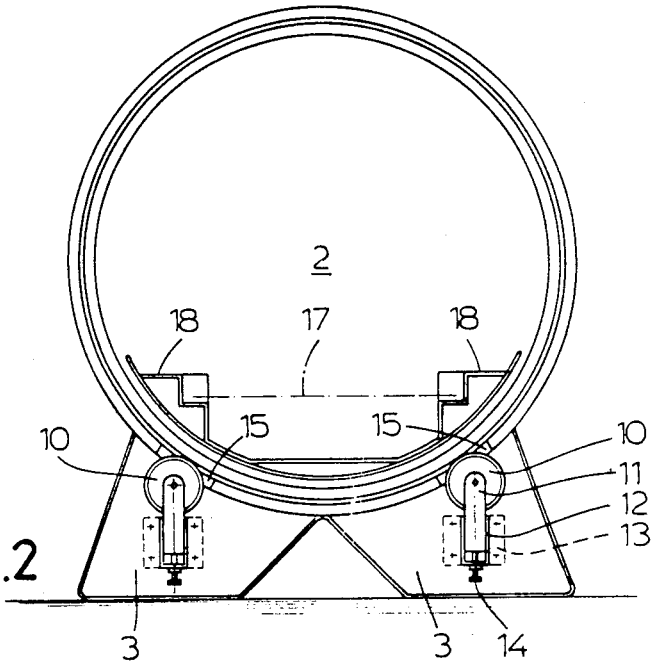
FIG. 2 is a section along the plane II—II in FIG. 3.
Figure 1:
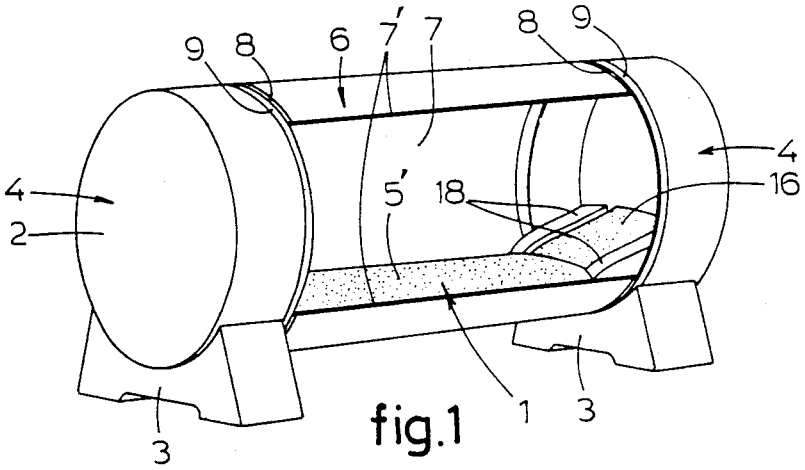
FIG. 1 is a schematic perspective view of an embodiment of a resting device according to the invention.

The resting device as shown in the drawings is provided with a lying means 1, which extends at a distance above the ground in an at least partial horizontal direction. The lying means is connected on either side to a vertical end wall 2 of a stationary end cylinder 4 supported by a base member 3. Of course it is also possible that the lying means 1 is connected to the cylindrical walls of the end cylinders 4.

The lying means 1, which may be executed as the lying portion of a bed, a divan-bed, a couch or the like, comprises a lower surface, which forms a portion of a cylinder and which consists of a shell 5 made of wood, metal or the like, on which a mattress 5' may be supported, which may be formed from foam rubber or the like material and which may be covered with a dirt repellent artificial material.

A circle cylinder 6 extends between the two end cylinders 4, which are directed with their open sides towards each other. This circle cylinder 6, which is coaxial with the two end cylinders 4, is supported for rotating movement about its at least substantially horizontal longitudinal axis and forms a tube-shaped envelope for the lying means 1.

An opening 7 for getting in and out of the device is formed in this rotatable cylinder 6. On either side of the rotatable cylinder 6 an uninterrupted stepped end ring 8 is mounted, which extends over the whole circumference. These end rings 8 are each partly received in a stationary stepped outer ring 9 with a slight play, which forms part of the stationary end cylinder 4 at the side in question. The end rings 8 of the rotatable cylinder 6 and the outer rings 9 of the end cylinders 4 may be made from metal, whilst the remaining parts of the two end cylinders 4 with their base members 3, as well as the remaining part of the rotatable cylinder 6, may be made at least substantially from artificial material.

The rotatable cylinder 6 is supported with its end rings 8 by means of support rollers 10. The axes of rotation of these support rollers 10 are parallel to the longitudinal axis of the rotatable cylinder 6.

Each support roller 10 is journalled between the legs of a U-section 11, which is adjustable in the vertical direction. For this purpose the U-section 11 is mounted between the legs of a U-section 12, which opens at the upper side. This U-section 12 acts as a carrier for the cooperating support roller 10 and is mounted with lips 13 to the inner end face of the base member 3 in question. The adjustment of each support roller 10 in the vertical direction may take place by means of an adjusting bolt 14, which is screwed in the U-section 12.

The stationary outer rings 9 of the two end cylinders 4 are provided with slots 15 at their lower side, through which the support rollers 10 protrude upwardly.

Figure 3:
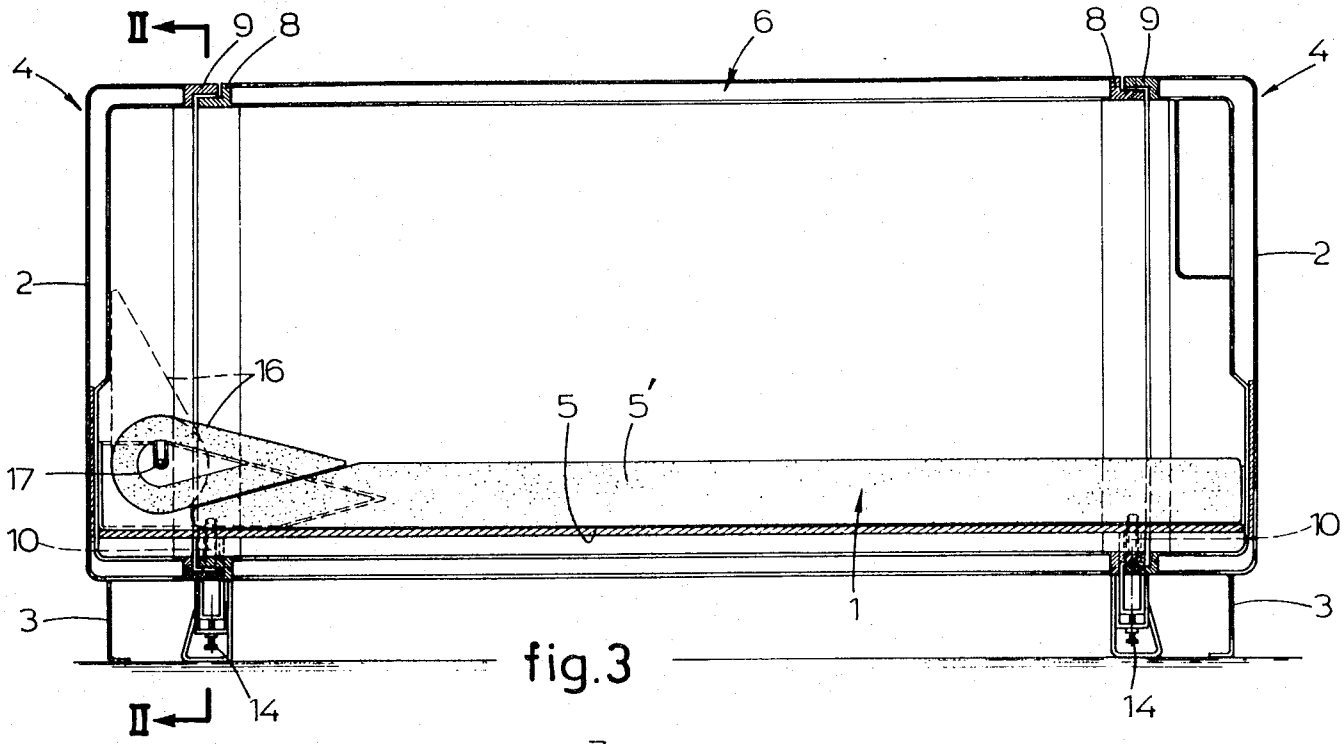
FIG. 3 is a vertical longitudinal section of the resting device according to FIG. 1.

As shown in FIG. 3 each base member 3 supports two support rollers 10, so that the rotatable cylinder 6 rests on four support rollers 10, whilst each outer ring 9 is provided with two slots 15.

The rotatable cylinder 6 is double-walled between the end rings 8 and may be filled with foam material or the like sound insulating material.

The opening 7 in the rotatable cylinder 6 is defined at two sides by an edge 7', which is parallel to the longitudinal axis of the rotatable cylinder 6 and at the two other sides by the end rings 8 or by the outer rings 9 of the end cylinders 4.

The lying means 1 may be provided with a pillow 16 at one side. In the embodiment shown in the drawings, this pillow 16 may pivot about a shaft 17 supported by the lying means 1. The pillow 16 may be displaced between a lowermost position shown in full lines, wherein the pillow surface adjoins the upper surface of the lying means 1, so that the pillow 16 may act as a pillow for the head of the resting person, and a highest position shown in dashed lines, wherein the pillow 16 rests against the vertical end wall 2 of the end cylinder 4 in question and may act as a support for the back of the resting person.

Stationary arm-rests 18 are positioned at either side of the pillow 16, whilst the upper surface of the lying means 1 is lowered underneath the pillow 16 so as to enable a person seated on this lying means 1 to use the arm-rests 18 and the pillow in the back in an agreeable manner.

On either side small shelves (not shown) may be mounted above the arm-rests 18. These shelves may be pivoted upwardly and may e.g. be used for refreshments.

In addition thereto, lamps may be provided at the head end of the device which may be used as a night illumination as well by means of a choke-coil.

If the device according to the invention will be rented for small periods of time, e.g. for several hours, a buzzer or the like may be mounted on the end wall 2 at the foot-end, which warns the resting person when the period of use is expired. This buzzer may also be used as an alarm.

Further, a lighted clock which shows the local time, may be suspended from this end wall 2.

A small rack for the hand luggage may be supported at this end wall 2 as well.

When the resting device is in operation on an airfield, a loudspeaker may be provided in the interior of the device, in order to inform the resting passenger of messages such as flight alterations, which may be of interest to him.

In case that the surroundings of the resting device according to the invention are provided with an air conditioning installation, it may be of interest to also connect the same to the resting device.

Figure 4:
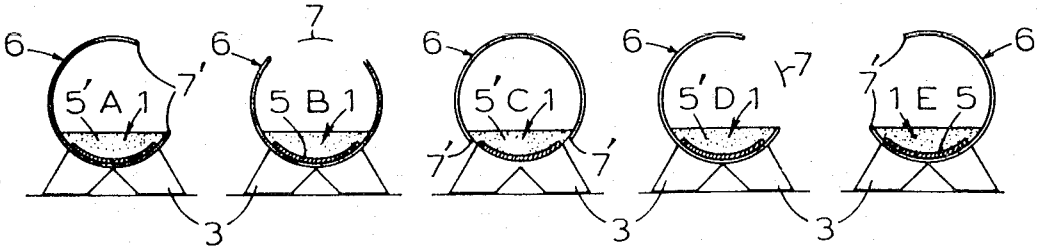
FIG. 4 shows very schematic cross-sections of the resting device according to FIG. 1, wherein the rotatable cylinder is shown in several positions.

In FIG. 4 the rotatable cylinder 6 is shown in several positions.

In the position indicated with A, the opening 7 is suitable for getting in and out of the device.

After a person has entered the device, he may rotate the cylinder 6, e.g. to the position B, wherein the opening 7 lies at the upper side. In this position it is possible to look upwardly while lying on the mattress 5', whilst one is nevertheless not visible from the outside of the device. When it is preferred to exclude light and noise from the resting device as much as possible the rotatable cylinder 6 is rotated to the position C, wherein this cylinder 6 substantially adjoins the lower surface of the lying means 1, which forms a portion of a cylinder. Of course, in this position still sufficient ventilation possibilities are present between the cylinder 6 and this lower surface.

The resting devices may be positioned in rows, beside and/or behind each other, e.g. in a waiting space of an airfield. If desired, the openings 7 in the rotatable cylinders 6 of adjacent resting devices may be rotated in opposite positions, as indicated with D and E, so that a resting space for two is created.

The resting device described hereinbefore and shown in the drawings may have a total length of e.g. 220 cm, while the diameter of the rotatable cylinder 6 may be e.g. 100 cm, if the device is meant for one person, as will be the case in general. In such embodiment the total height of the resting device may be e.g. 125 cm. The length of the rotatable cylinder 6 may be 150 cm, in which case the end cylinders 4 may have a length of approximately 35 cm.

The lower edge 7' of the opening 7 in the cylinder 6 may lie at a height of approximately 45 cm above the ground in the position for getting in and out of the device as shown in FIG. 4A. In that position the upper edge 7' of the opening 7 lies e.g. approximately 120 cm above the ground.

Apart from the application on airfields and motorway restaurants, in offices and in industries the resting devices according to the invention are also very suitable for being positioned in railway station spaces, in particular in countries wherein a lot of travelling and changing takes place during the night as well.

These resting devices may also be used on ferryboats instead of cabins and on the terminals of these ferryboats.

The resting device according to the invention may further be designed for private use, in which case the device may e.g. be positioned in a separation wall between adjacent rooms or spaces, such as a sitting-room and a bedroom, or a sitting-room and a terrace. In this manner the possibility is obtained to enter the device in one space and to leave the device in the other space, if desired. Thus, two rooms or spaces may be provided simultaneously with one resting device.

These resting devices for private use may contain more luxury and comfort and may have a length of e.g. 3 m, while the diameter of the rotatable cylinder 6 may be 150 cm, if designed for two persons.

The lying means 1 may comprise a lying surface of leather of e.g. 120×200 cm, while loose pillows may be used.

These resting devices for private use may be provided with air conditioning, a bar, a refrigerator, television and the like attributes for improving its comfort.

In general the rotation of the rotatable cylinder 6 will take place by hand. However, in the more luxury embodiment mentioned hereinbefore the rotation may be realized by means of a motor.

The invention is not restricted to the embodiment shown in the drawings by way of example, which may be varied in several ways within the scope of the appended claims.

It is e.g. possible to make the opening 7 in the cylinder 6 for getting in and out of the device smaller in the horizontal direction than in the embodiment shown in the drawings. In that case this opening 7 will end at some distance from the end cylinders 4, so that this opening 7 will be bounded by the material of the rotatable cylinder 6 along its four sides.

I claim:

1. Resting device, comprising an at least partly horizontal lying means extending at a distance above the ground and connected at its end with uprights, which lying means is provided with an adjustably supported tube-shaped envelope, in which an opening is formed for getting in and out of the device, said envelope comprising on both sides an end ring, which end rings are supported within the uprights by support rollers, wherein the tube-shaped envelope is substantially formed as a circle cylinder which is rotatable about its at least approximately horizontal longitudinal axis, said support rollers having axes of rotation, which are parallel to said longitudinal axis, and wherein the lying means is connected on both sides to a stationary end cylinder, which is supported by a base member and which is provided with a vertical end wall, each end cylinder forming one of the said uprights, said end cylinders being directed with their open sides towards each other and being coaxial with the intermediate rotatable cylinder, while each support roller is supported by a carrier, which is mounted within one of the base members and which is connected to this base member, the end rings extending over the whole circumference on both sides of the rotatable cylinder, while each end ring is at least partly received in a stationary outer ring with a slight play, each outer ring forming a part of one of the end cylinders and having openings for the support rollers.

2. Resting device as claimed in claim 1, wherein the opening in the rotatable cylinder is bounded on two sides by an edge which is parallel to the longitudinal axis of the rotatable cylinder and on the other two sides by the uprights.

3. Resting device as claimed in claim 1, wherein the end rings of the rotatable cylinder and the outer rings of the end cylinders are formed of metal, while the remaining parts of the two stationary end cylinders with their base members, as well as the remaining part of the rotatable cylinder are substantially made of artificial material.

4. Resting device as claimed in claim 3, wherein each base member is provided with two support rollers.

5. Resting device as claimed in claim 4, wherein each support roller is adjustable in height with respect to its carrier.

6. Resting device as claimed in claim 3, wherein the rotatable cylinder is double-walled between the end rings and is filled with foam material.

7. Resting device as claimed in claim 1, wherein the lower surface of the lying means forms a portion of a cylinder, while the opening in the rotatable cylinder for getting in and out of the device, when placed in its lowermost position, adjoins this lower surface of the lying means in an air-permeable manner.

8. Resting device as claimed in claim 1, wherein a pillow is supported on the lying means, which pillow is adapted to pivot about a horizontal axis between a lowermost position in which the upper surface of the pillow adjoins the upper surface of the lying means, and a highest position in which the pillow rests against the vertical end wall of one of the end cylinders.

9. Resting device as claimed in claim 8, wherein armrests are positioned at either side of the pillow.

10. Resting device as claimed in claim 9, wherein the upper surface of the lying means comprises a lowered portion underneath the pillow.

* * * * *